US006638019B2

(12) United States Patent
Mehta

(10) Patent No.: US 6,638,019 B2
(45) Date of Patent: Oct. 28, 2003

(54) CEILING FAN

(75) Inventor: Vinay Mehta, Germantown, TN (US)

(73) Assignee: Hunter Fan Company, Memphis, TN (US)

( * ) Notice: Subject to any disclaimer, the term of this patent is extended or adjusted under 35 U.S.C. 154(b) by 0 days.

(21) Appl. No.: 09/990,483

(22) Filed: Nov. 16, 2001

(65) Prior Publication Data

US 2003/0095880 A1 May 22, 2003

(51) Int. Cl.[7] ..... F04D 25/08

(52) U.S. Cl. ..... 416/170 R; 310/67 R; 310/157; 310/261; 417/354; 417/424.1; 417/423.7

(58) Field of Search ..... 416/5, 170 R; 417/354, 423.7, 424.1; 310/67 R, 157, 261

(56) References Cited

U.S. PATENT DOCUMENTS

| | | | | | |
|---|---|---|---|---|---|
| 2,772,046 | A | * | 11/1956 | Shomphe | 310/67 R |
| 3,175,755 | A | * | 3/1965 | Rockafield | 310/67 R |
| 3,385,510 | A | * | 5/1968 | Hollander | 417/354 |
| 4,073,598 | A | * | 2/1978 | Mizutani et al. | 416/170 R |
| 4,621,977 | A | * | 11/1986 | Markwardt | 416/170 R |
| 4,692,096 | A | * | 9/1987 | Yang | 416/170 R |
| 5,135,365 | A | * | 8/1992 | Bogage | 417/424.1 |
| 5,883,449 | A | * | 3/1999 | Mehta et al. | 416/5 |

* cited by examiner

*Primary Examiner*—Michael Koczo
(74) *Attorney, Agent, or Firm*—Baker Donelson

(57) ABSTRACT

A ceiling fan has a stator 38 rigidly mounted to a shaft 33 and a rotor 40 rotatably mounted to the same shaft about the stator. The shaft is rigidly mounted to a housing. The rotor is supported upon a thrust bearing.

5 Claims, 3 Drawing Sheets

CEILING FAN

TECHNICAL FIELD

This invention relates generally to electrically powered fans, and particularly to ceiling fans.

BACKGROUND OF THE INVENTION

There are several types of fans that are used within a room to circulate room air. These include portable fans that may be set up on the floor or on furniture, wall mounted fans, and ceiling fans. Portable fans and wall fans often oscillate. Whether or not they oscillate all three types of fans have a motor driven shaft to which an annular array of fan blades is mounted.

There are two principal types of electric motors used to rotate the blades of ceiling fans. The more popular type has a stationery stator mounted on an upright shaft. The rotor is rotatably mounted about the stator. This is known both as a direct drive motor and as an inside-out motor. The less popular type ceiling fan motor has the stationery stator surrounding the rotor that drives the fan blades.

Ceiling fans are mounted to ceilings with their motor rotors and stators oriented about vertical axes. So oriented, the bearings are subjected to axial loading from the dead weight of the fan system. That system includes the fan housing, rotor, blades, suspension system and any light kit. Ball bearings are typically employed which are designed for radial rather than axial loading. This serves to considerably limit the bearing life which results in imbalance and audible noise. To alleviate this problem thrust bearings have been used for axial loading which are totally submerged in oil to support the rotor. Although this serves to substantially enhance bearing life, and virtually to eliminate bearing-generated noise, such motors have still remained rather noisy. Moreover, the noise level of such has been erratic and inconsistent from one fan to the next.

Accordingly, it is seen that a need has long existed for a ceiling fan with good motor longevity and that is consistently quiet. It is to the provision of such that the present invention is primarily directed.

SUMMARY OF THE INVENTION

It has been found that the inconsistency and the excessiveness in the level of audible noise generated by ceiling fan operations arises primarily from inconsistence in the size and shape of the annular air gap between the rotor and stator of the fan motor. A new ceiling fan is substantially free of this problem. It comprises a housing adapted to be suspended from a ceiling. A shaft is mounted generally vertically in the housing with a cylindrical bearing surface located within the housing. An electric motor is mounted within the housing with its stator rigidly mounted to the shaft, it being adapted to be coupled with a source of electric power. The motor rotor is rotatably journaled about the shaft bearing surface radially about the stator. So constructed, the annular air gap between stator and rotor may be small for dynamoelectric efficiency and yet remain dimensionally consistent between manufactured lots even after packaging, shipment, installation and operation. This also results in consistently quiet fan operations.

DETAILED DESCRIPTION

Figure 1:
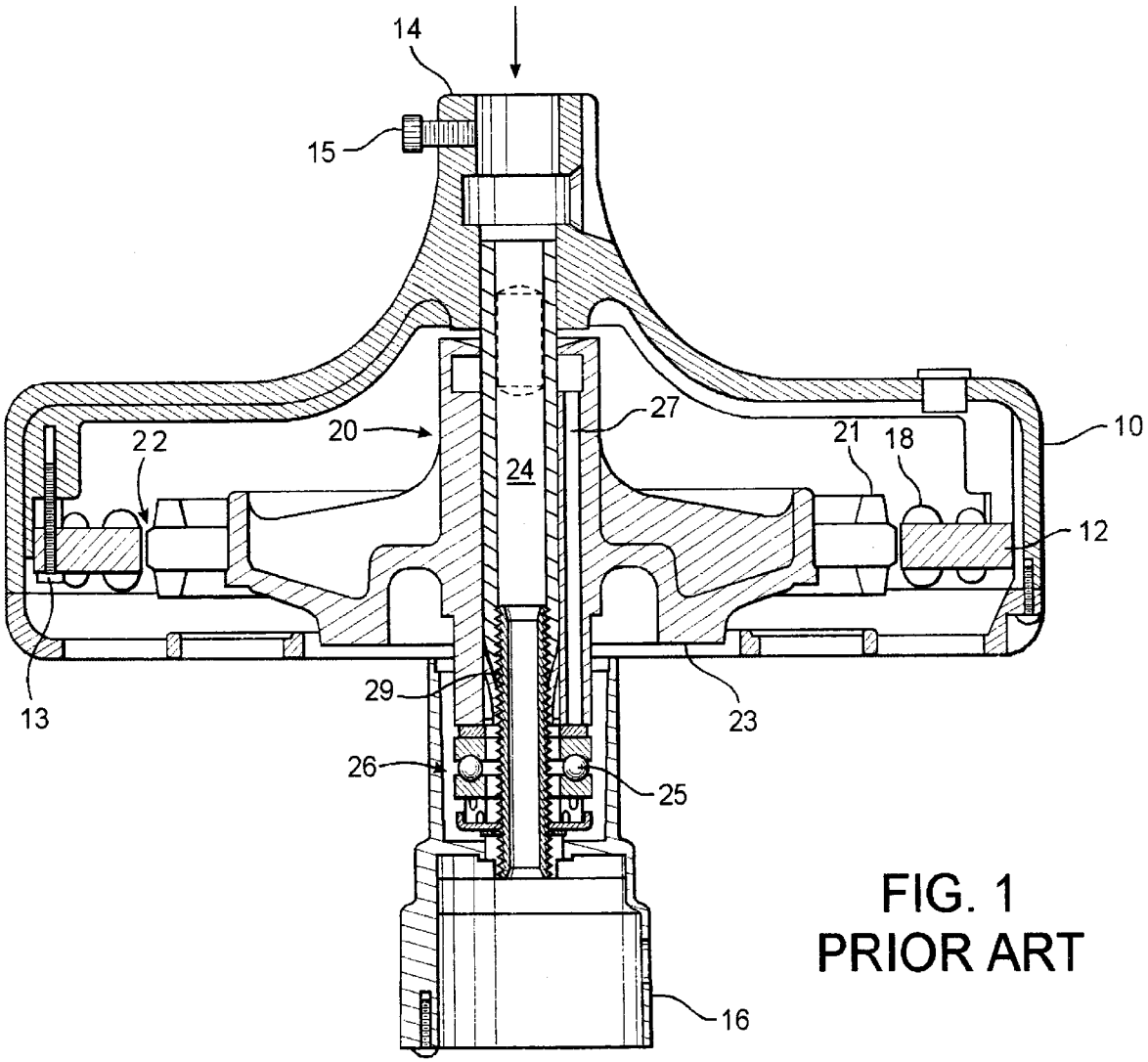
FIG. 1 PRIOR ART
FIG. 1 is a view, in cross-section, of a ceiling fan of the prior art.

Referring now in more detail the drawing, there is shown in FIG. 1 a ceiling fan that has been produced and sold by the Hunter Fan Corporation of Memphis, Tenn. for a number of years. It is seen to have a housing 10 to the inside wall of which an annular stator 12 is rigidly mounted by screws 13. The top of the housing has a neck 14 with set screw 15 that secures it to an unshown suspension pole or down rod that is mounted to a ceiling of a room. The mounting pole and neck are tubular to accommodate an unshown electric power line that connects the stator with the room and building power through a switch box. The bottom of the housing has a switch housing 16 that houses additional unshown wiring and a switch for a light unit that depends from the housing.

An electric motor rotor 20 is mounted for rotation within the housing which has windings 21 adjacent windings 18 of the stator 12. An annular air gap 22 exists between the rotor and stator in which a magnetic force field exists when the stator is electrically energized to drive the rotor. The rotor has a flywheel portion 23 to the bottom which an annular array of unshown blade irons is mounted. Fan blades are in turn mounted to the blade irons.

The rotor 20 is journaled about a tubular shaft 24 which is press fitted into the housing neck 14. The rotor is supported upon a thrust bearing 25 mounted in an oil sump 26 above the switch housing 16. The outside of the shaft 24 has an unshown groove through which oil from the sump 26 rises under the centrifugal forces generated by the rotor and is returned to the sump via a channel 27. The bottom of the shaft 24 has internal threads in which a tubular post 29 extension of the switch housing 16 is threaded in mounting it to the housing 10. The post 29 accommodates a power line connection to the switch housing 16.

Figure 2:
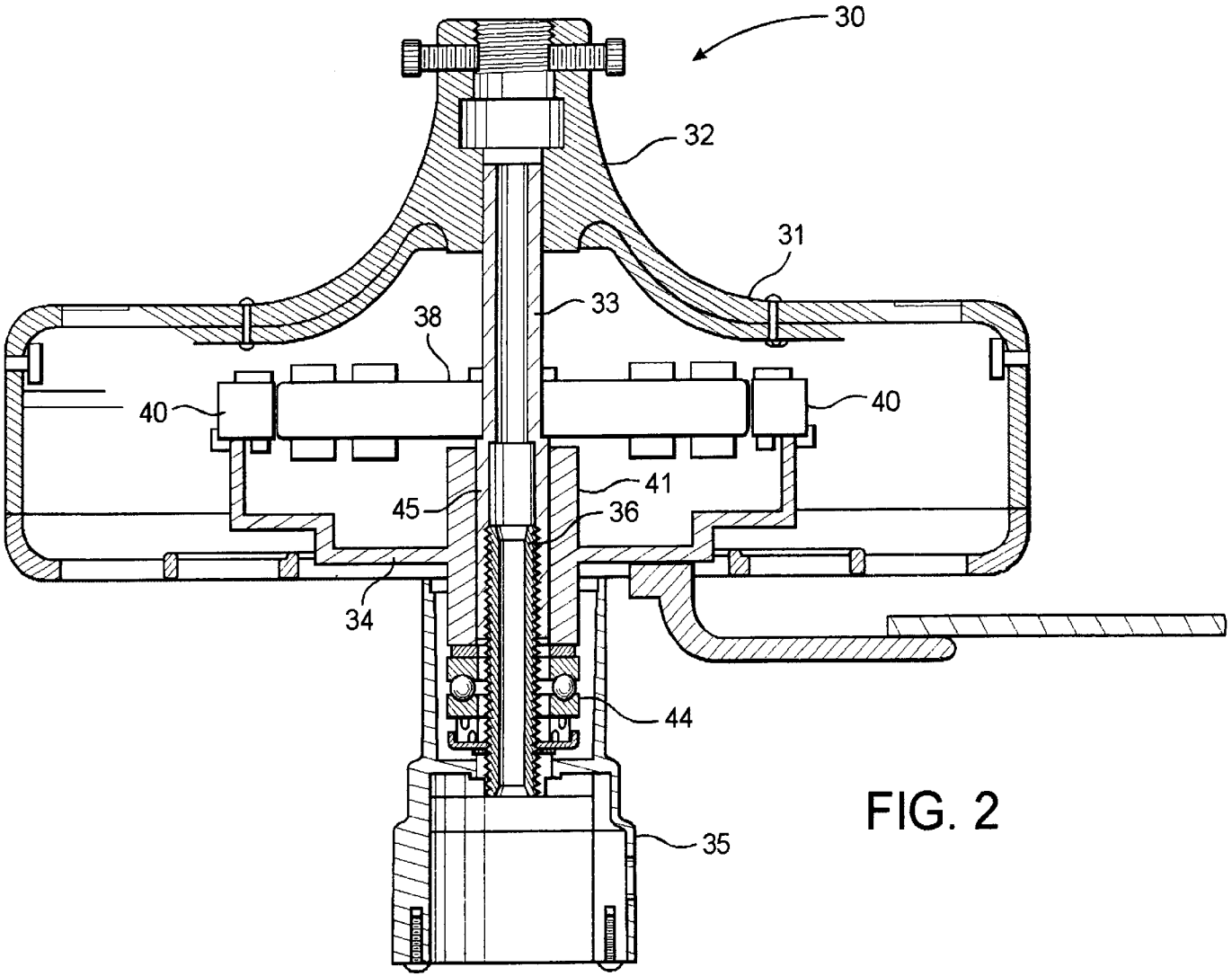
FIG. 2 is a view, in cross-section, of a ceiling fan that embodies principles of the present invention in its preferred form.
Figure 3:
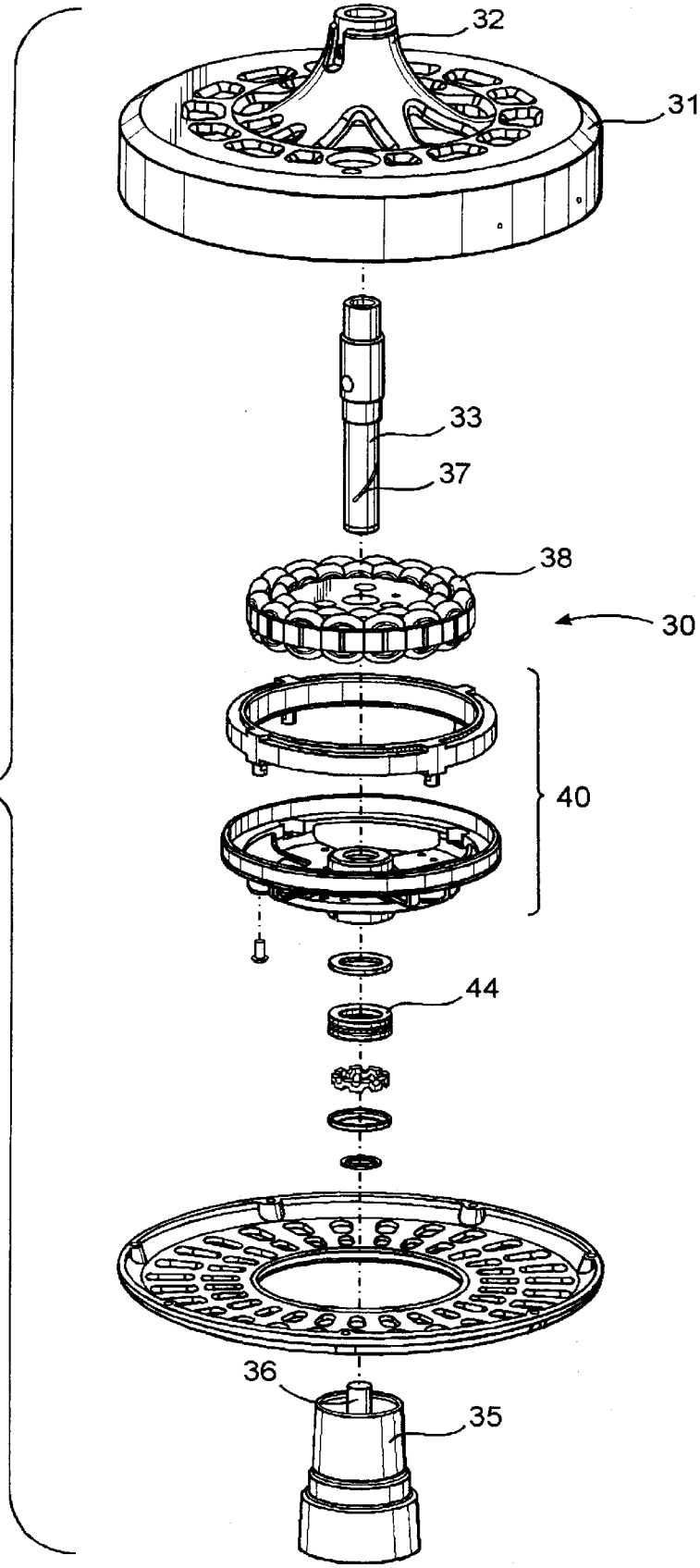
FIG. 3 is an exploded view, in perspective, of components of the new ceiling fan shown in FIG. 2.

With reference next to FIGS. 2 and 3, the new ceiling fan 30 has a housing 31 with a tubular neck 32 to which a tubular, cylindrical shaft 33 is press fitted. Again, a switch housing 35 is mounted to the housing 31 by threading a post extension 36 into the bottom of the shaft 33 that has its oil rise slot shown at 37. An annular electric motor stator 38 is rigidly mounted to the shaft 33 within the housing 31. The stator windings are connected to power by unshown wiring. A rotor 40 is also mounted to the shaft 33, albeit rotatably. Specifically, the rotor has a bearing sleeve 41 journaled about a lower bearing surface portion of the cylindrical shaft 33. A flywheel portion 34 of the rotor unitarily links the sleeve portion 41 with the windings bearing portion of the rotor that is positioned closely about the stator 38, the two being spaced apart by a small annular air gap. A set of blade irons, to which a set of fan blades is mounted, is mounted to the flywheel portion, only one of each which is shown in FIG. 2, for clarity of illustration. The rotor is supported upon a thrust bearing 44 that is submerged in oil within a sump to be lubricated as explained before with reference to the fan shown in FIG. 1. The rotor and stator themselves are of conventional construction.

By mounting both the stator 38 and rotor 40 to the same shaft 33 their alignment with respect to each other is precisely established. Moreover, during handling and fan operation their relative alignment is maintained consistently which enables the air gap between them to be small for dynamoelectric efficiency. It has been found that this small air gap is consistent between manufacture lots which results in very quiet fan operations. Where stresses are placed on the fan housing, such are not translated to the rotor or stator in a manner to cock one relative to the other. Thus even were the housing to be bent or impacted slightly, whether during manufacture, packaging, handling, mounting or during use, the dimensional and geometric relation between the stator and rotor is maintained.

To reiterate, with the stator mounted to the same shaft about which the rotor rotates, they both are assembled with the same reference at the shaft. With this common reference, any error in shaft alignment is equally reflected to stator and rotor alike. Again, this keeps the annular air gap between them consistent and concentric. This in turn enables the one gap to be very small so that the rotor operated with less electrical losses thereby increases motor efficiency. In addition, with this new construction the lubricating oil need not be pumped as high which yields more efficiency in that less oil is required.

It thus is seen that this new ceiling fan provides distinct advances in this mature art. Although the invention has been described and illustrated in its preferred form, it should be understood that many modifications, changes, or additions may be made without departure from the spirit and scope of the invention a as set forth in the following claims.

What is claimed is:

1. A ceiling fan comprising a housing adapted to be suspended stationarily from a ceiling; a shaft mounted to said housing and having a cylindrical bearing surface located within said housing; an electric motor mounted within said housing with its stator rigidly mounted to said shaft and with its rotor rotatably journaled about and in direct contact with said shaft bearing surface radially about said stator; and a plurality of fan blades mounted to said rotor.

2. The ceiling fan of claim 1 wherein said electric motor rotor is supported upon a thrust bearing submerged in lubricating oil.

3. The ceiling fan of claim 1 wherein said electric motor rotor has a sleeve bearing portion rotatably journaled about a bearing surface of said shaft.

4. The ceiling fan of claim 3 wherein said electric motor rotor has a flywheel portion.

5. The ceiling fan of claim 1 wherein said shaft is rigidly mounted to said housing.

* * * * *